US005776011A

United States Patent [19]

Su et al.

[11] Patent Number: 5,776,011

[45] Date of Patent: Jul. 7, 1998

[54] GOLF CLUB HEAD

[75] Inventors: Charles Su, Taiwan, China; Phil Chang, Walnut, Calif.

[73] Assignee: Echelon Golf, Industry, Calif.

[21] Appl. No.: 723,234

[22] Filed: Sep. 27, 1996

[51] Int. Cl.[6] ..... A63B 53/04

[52] U.S. Cl. ..... 473/345; 473/349; 473/350; 473/338; 473/327

[58] Field of Search ..... 473/345, 349, 473/350, 334, 338, 305, 335, 342, 327, 317

[56] References Cited

U.S. PATENT DOCUMENTS

| | | | |
|---|---|---|---|
| 1,659,272 | 2/1928 | Link . | |
| 2,056,335 | 10/1936 | Wettlaufer . | |
| 2,257,575 | 9/1941 | Reach | 473/338 |
| 3,556,533 | 1/1971 | Hollis . | |
| 3,692,306 | 9/1972 | Glover | 473/338 X |
| 3,947,041 | 3/1976 | Barber | 473/349 X |
| 4,206,924 | 6/1980 | Koralik | 473/349 |
| 4,607,846 | 8/1986 | Perkins . | |
| 4,795,159 | 1/1989 | Nagamoto . | |
| 4,809,983 | 3/1989 | Langert . | |
| 4,811,949 | 3/1989 | Kobayashi . | |
| 4,826,172 | 5/1989 | Antonious . | |
| 4,867,458 | 9/1989 | Sumikawa et al. . | |
| 4,869,507 | 9/1989 | Sahm . | |
| 4,884,808 | 12/1989 | Retzer | 473/342 X |
| 5,004,241 | 4/1991 | Antonious | 473/345 X |
| 5,050,879 | 9/1991 | Sun et al. | 473/338 |
| 5,056,705 | 10/1991 | Wakita et al. . | |
| 5,154,424 | 10/1992 | Lo . | |
| 5,219,408 | 6/1993 | Sun . | |
| 5,232,224 | 8/1993 | Zeider . | |
| 5,242,167 | 9/1993 | Antonious . | |
| 5,271,621 | 12/1993 | Lo | 473/345 |
| 5,273,283 | 12/1993 | Bowland | 473/345 X |
| 5,344,140 | 9/1994 | Anderson . | |
| 5,346,217 | 9/1994 | Tsuchiya et al. . | |
| 5,405,136 | 4/1995 | Hardman . | |
| 5,421,577 | 6/1995 | Kobayashi . | |
| 5,429,357 | 7/1995 | Kobayashi . | |
| 5,431,401 | 7/1995 | Smith . | |
| 5,447,307 | 9/1995 | Antonious . | |
| 5,451,048 | 9/1995 | Magamoto et al. . | |
| 5,451,056 | 9/1995 | Manning . | |
| 5,460,371 | 10/1995 | Takeda . | |
| 5,485,998 | 1/1996 | Kobayashi . | |
| 5,501,459 | 3/1996 | Endo | 473/334 X |
| 5,547,427 | 8/1996 | Rigal et al. | 473/345 |
| 5,564,705 | 10/1996 | Kobayashi et al. | 473/334 |

*Primary Examiner*—Raleigh W. Chiu
*Attorney, Agent, or Firm*—Raymond Sun

[57] ABSTRACT

A metalwood golf club head is provided by attaching three distinct stamped pieces: a face and hosel piece, a crown piece and a bottom piece. The hosel of the face and hosel piece has a diameter and a narrowed section adjacent the heel, the narrowed section having a width from the toe to heel direction which is less than the diameter of the hosel. The bottom piece includes a threaded opening for threadably coupling a removable weight which may be selected from a set of removable weights, with each removable weight in the set having a different weight. Weighting is provided on a rear surface of the face, and may take the form of either a plurality of concentric masses or a spiral mass extending rearwardly from the rear surface of the face.

19 Claims, 5 Drawing Sheets

GOLF CLUB HEAD

BACKGROUND OF THE INVENTION

1. Field of the Invention

The present invention relates to golf clubs, and in particular, to a metalwood golf club head that is made by attaching together three metal pieces that have been forged or stamped. The club head may also optionally include one or more of a pinched or narrowed hosel, a replacable screw weight provided in the sole of the club head, and a mass provided behind the face.

2. Description of the Related Art

Traditional golf wood club heads were made of wood, such as laminated maple or a solid block of persimmon, which is cut and sanded into the desired shape. Since the club head was made of solid wood, it was difficult to distribute weight around the club head. Weight distribution around the club head became important because it was realized that proper weight distribution at certain locations of the club head could greatly assist a golfer to hit the ball more accurately, and in some instances, hit the ball further.

In the early 1970's, a process was designed for investment cast steel to be shaped in the configuration of a wood club head having a hollow center. Such club heads made from investment cast steel were known as "metalwoods". Using this process, molten or liquefied metal is poured into a casting mold and then allowed to cool to form the desired configuration. One common form of this process was to provide the club head in two cast pieces, the first piece comprising the face, the peripheral sides and the top or crown of the club head, with an opening in the bottom of the club head, and the second piece essentially comprising the sole plate that is then welded to the opening in the first piece. A cast metalwood allows the manufacturer to distribute weight at different locations of the club head.

However, one drawback associated with cast club heads is that the resulting club head will have differing strengths throughout the club head. This is caused by the fact that different parts of the molten metal cool at different speeds, so that the amount of contraction of the metal material will vary throughout the club head.

To overcome this drawback and to provide a club head having more consistent hardness, density, thickness and strength, forged metal club heads were produced. Using this process, the different pieces that comprise the club head are first forged or stamped out of a rod of aluminum with alloys and the different pieces are then attached together, typically by welding, to form the desired club head. The forging or stamping action ensures that the metal throughout the particular piece has consistent hardness, density, thickness and strength.

There is currently available certain forged club heads that are made by welding four separate forged pieces: a crown piece, a sole plate, a face plate and a hosel piece. However, there are drawbacks associated with welding these four forged pieces together. The most serious drawback is that the edges where the pieces are welded together tend to be structurally weak. With four separate pieces, there are many edges that need to be welded together, so there are many locations along the club head that may potentially be structurally weak. This problem is particularly troublesome along the edges of the face plate, since the welds on the leading edges of the crown piece, the hosel piece and the sole plate incur additional stress when the face plate strikes a golf ball. This may also make it difficult to consistently provide the face plate at the desired loft angle. In addition, current titanium blend metalwoods that are formed from four forged pieces are weakest at their weld points due to complexities in the welding procedures in having to eliminate oxygen in the environment surrounding the weld.

Notwithstanding the above-described efforts and improvements, there still remains a need for a metalwood club head that is made from a plurality of forged metal pieces having improved consistency in hardness, density, thickness, strength and loft angles, that has an improved and stronger face, and that has improved weight and other design attributes which assist the average golfer in hitting the ball further and more accurately.

SUMMARY OF THE INVENTION

The objects of the present invention may be achieved by providing a metalwood golf club head comprising a face, a hosel, a crown piece and a bottom piece. The face has a toe, a heel, a top edge, a bottom edge, and a center of percussion located at an approximate center of the face. The hosel has a diameter and a narrowed section adjacent the heel, the narrowed section having a width from the toe to heel direction which is less than the diameter of the hosel. The crown piece has a peripheral edge and a front edge. The bottom piece has a peripheral side wall connected to a sole plate, the peripheral side wall including a peripheral edge, and the sole plate including a front edge. The peripheral edge of the crown piece is attached to the peripheral edge of the bottom piece, the front edge of the crown piece is attached to the top edge of the face and the hosel, and the front edge of the bottom piece is attached to the bottom edge of the face.

In one embodiment according to the present invention, the face and the hosel are provided in one stamped piece. The face and hosel piece includes a curved hosel edge below the hosel, with the curved hosel attached to a curved edge of the crown piece. Thus, the club head according to this embodiment is made from three separate stamped pieces: the face and hosel piece, the crown piece, and the bottom piece.

In another embodiment of the present invention, the sole plate includes a threaded opening for threadably coupling a removable weight. A set of removable weights can be provided with the club head of the present invention, with each removable weight having a different weight, so that the golfer can select the desired weight depending upon the conditions of a given round of round. Each removable weight can be provided with the same length but with different weights, or can be provided in different lengths to vary the weight throughout the set.

Another embodiment of the present invention provides weight or mass on a rear surface of the face. In one embodiment, a spiral mass provided at the rear surface of the face behind the center of percussion, the spiral mass having a raised edge extending rearwardly from the rear surface and including an inner end and an outer end, with the spiral mass extending gradually in a spiral manner to a wider diameter from the inner end to the outer end. In another embodiment, a plurality of concentric masses is provided at the rear surface of the face substantially behind the center of percussion, the plurality of concentric masses including at least a first concentric mass and a second concentric mass, the first concentric mass having a diameter which is smaller than the diameter of the second concentric mass and being positioned inside the second concentric mass.

Therefore, the golf club head manufactured according to the present invention can be made with loft angles that are consistently close to the desired loft angles, and to reduce inconsistencies and structural weaknesses that may be caused by attaching separate face and hosel pieces. This is accomplished by stamping the hosel in one piece with the face. The golf club head according to the present invention also promotes greater accuracy and increased distance on golf shots by providing a narrowed section at the hosel, concentrating more weight or mass directly behind the center of percussion, and threadably coupling one weight from a set of removable weights to the sole plate.

DESCRIPTION OF THE PREFERRED EMBODIMENTS

Figure 1:
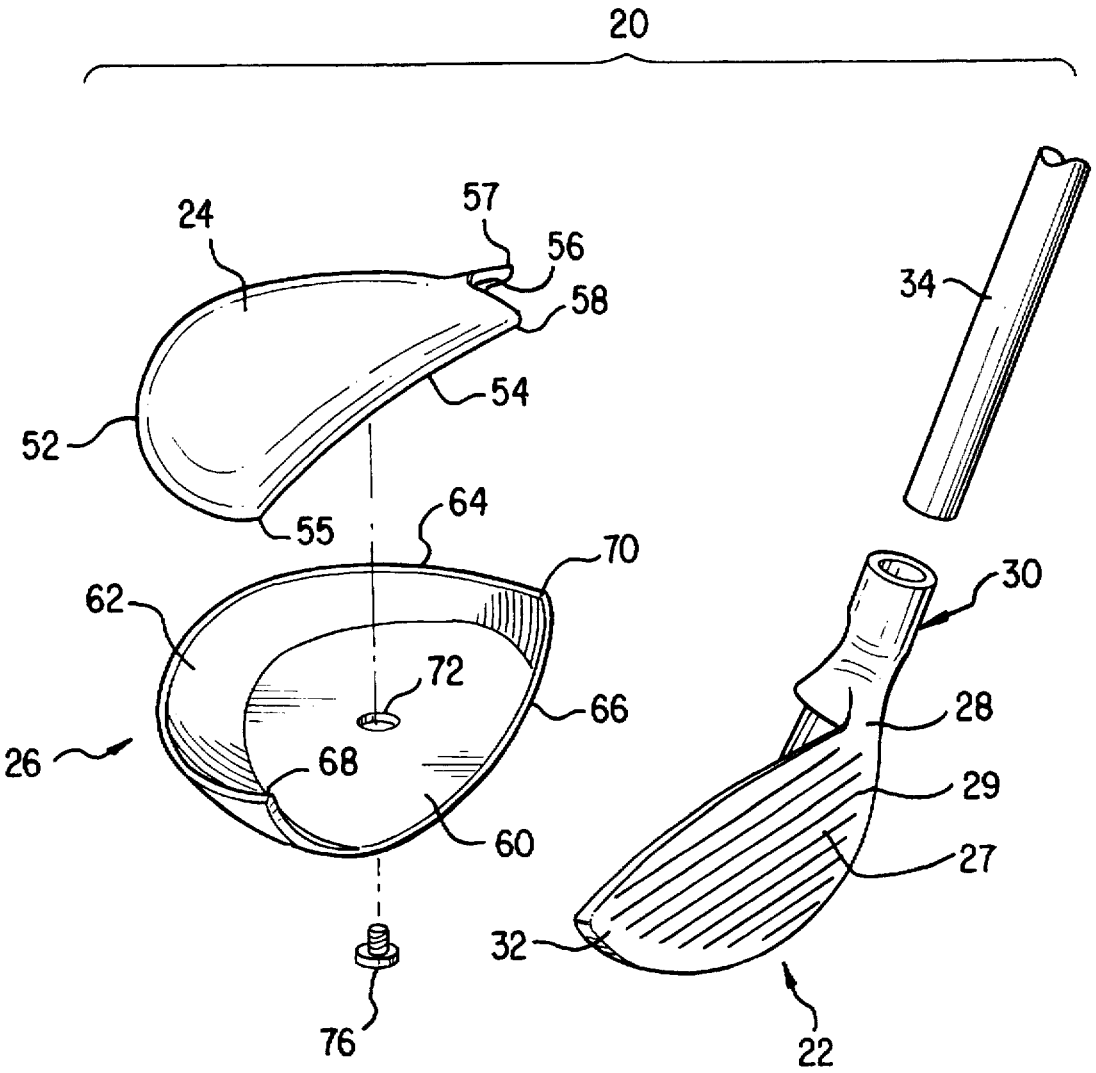
FIG. 1 is an exploded perspective view of a first embodiment of the metalwood of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1–6 illustrate a first preferred embodiment of the present invention. A golf club head or metalwood 20 is made by attaching three separate pieces of forged or stamped metal: a face and hosel piece 22, a crown or top piece 24 and a bottom piece 26.

The face and hosel piece 22 has a ball-striking face 27, a heel portion 28, a hosel 30, and a toe portion 32, all of which are forged or stamped as one piece. The face 27 has a center of percussion or "sweet spot" CP, which represents the spot of desired contact with the ball. This center of percussion CP is preferably located at approximately the center of the face 27 and has a diameter of approximately 1.685 inches, which is the diameter of a golf ball designed to meet the specifications of the United States Golf Association. However, depending on the size of the club head 20, the center of percussion CP could have a slightly larger size, and could extend a small distance in any direction from the exact center of the face 27.

In addition, the surface of the face 27 is positioned at an angle (see FIG. 6) to provide the desired club head loft. For example, the face 27 of a driver is typically provided with a 8 to 12 degree loft, while that of a three-wood is typically provided with a 15 degree loft. The surface of the face 27 has scorelines 29 provided horizontally across for increasing friction between the ball and the face 22, which increases the spin on the ball to enable the ball to perform better aerodynamically.

A shaft 34 is connected to the club head 20 at the hosel 30 disposed adjacent to the heel portion 28. The hosel 30 has an opening 36 at its top end which leads to a bore for receiving and retaining the shaft 34. The shaft 34 may be of any particular configuration and length and may be customized to meet each golfer's needs, and may be made from stainless steel or reinforced composites, such as boron, graphite, titanium or aluminum.

Figure 2:
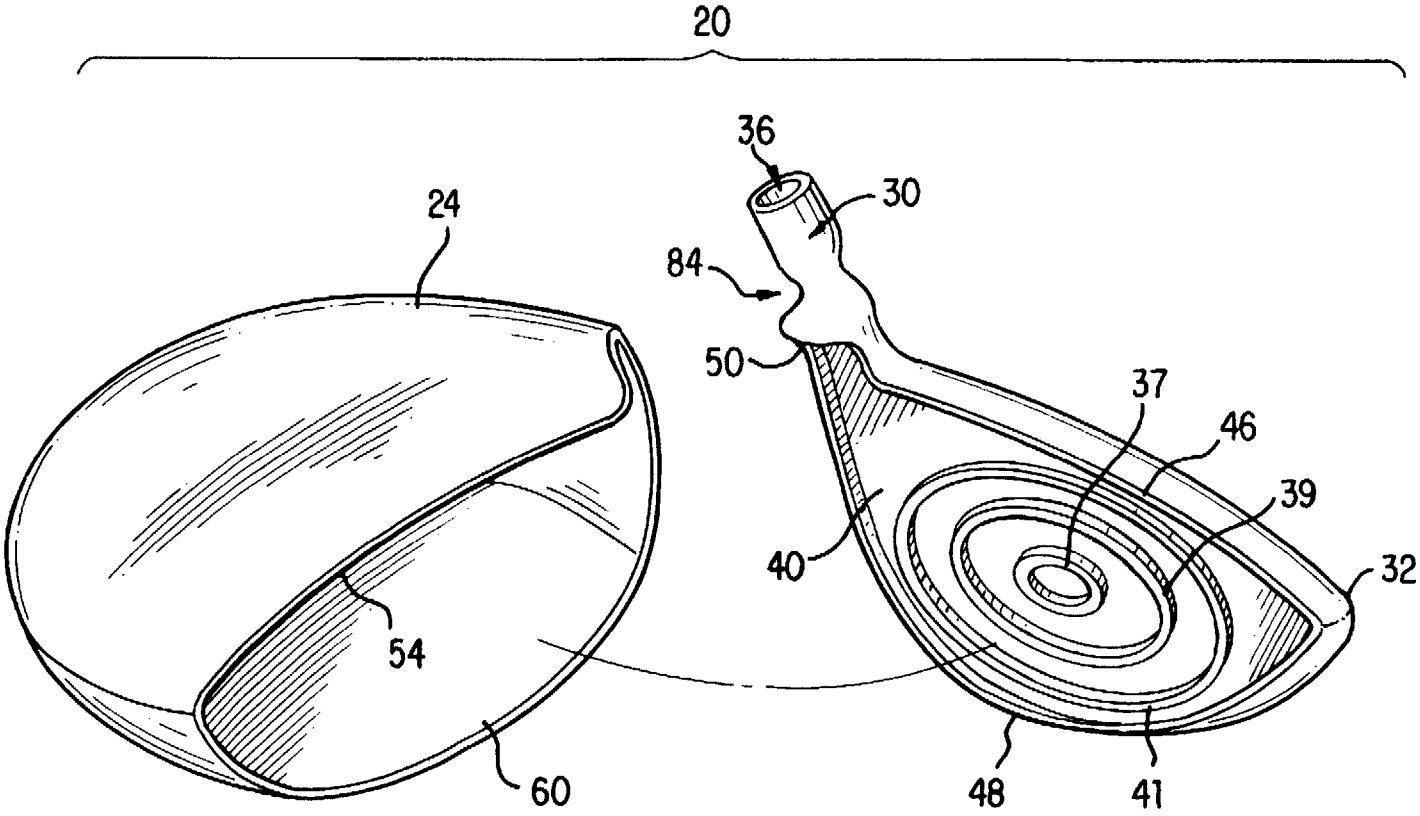
FIG. 2 is another exploded perspective view of the metalwood of FIG. 1.
Figure 3:
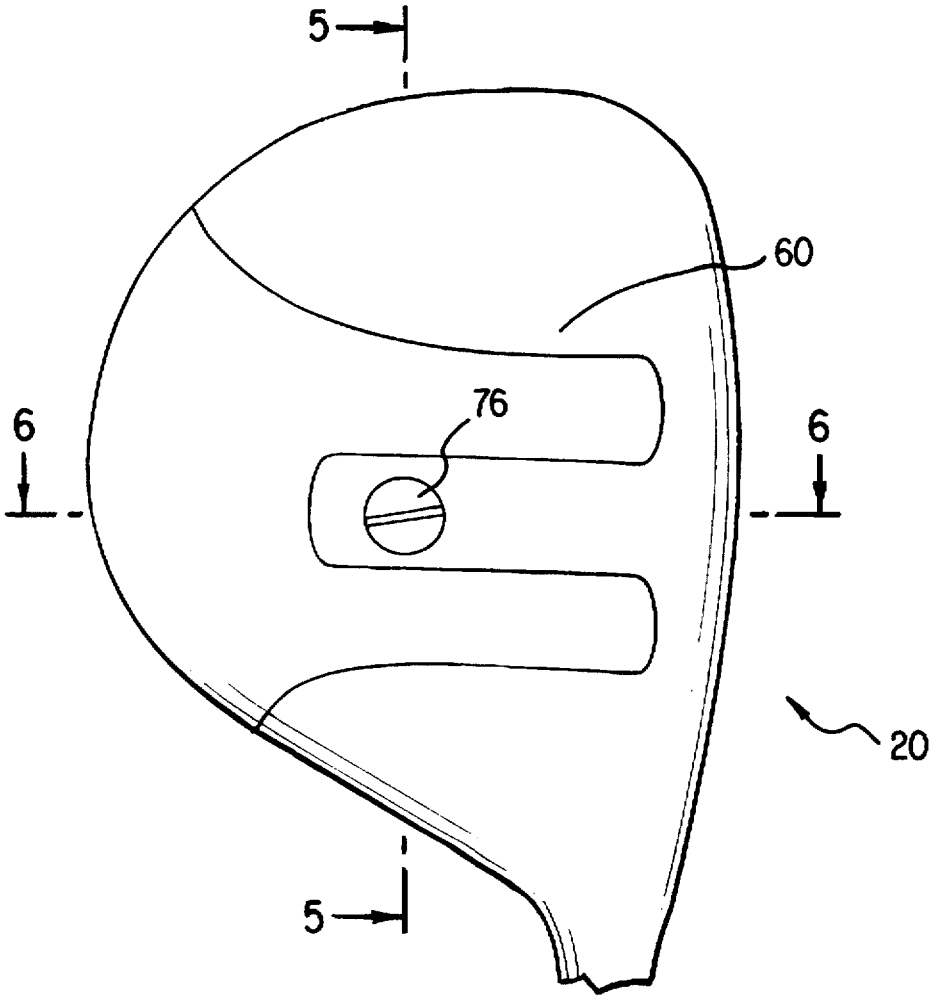
FIG. 3 is a bottom plan view or sole view of the metalwood of FIG. 1.
Figure 4:
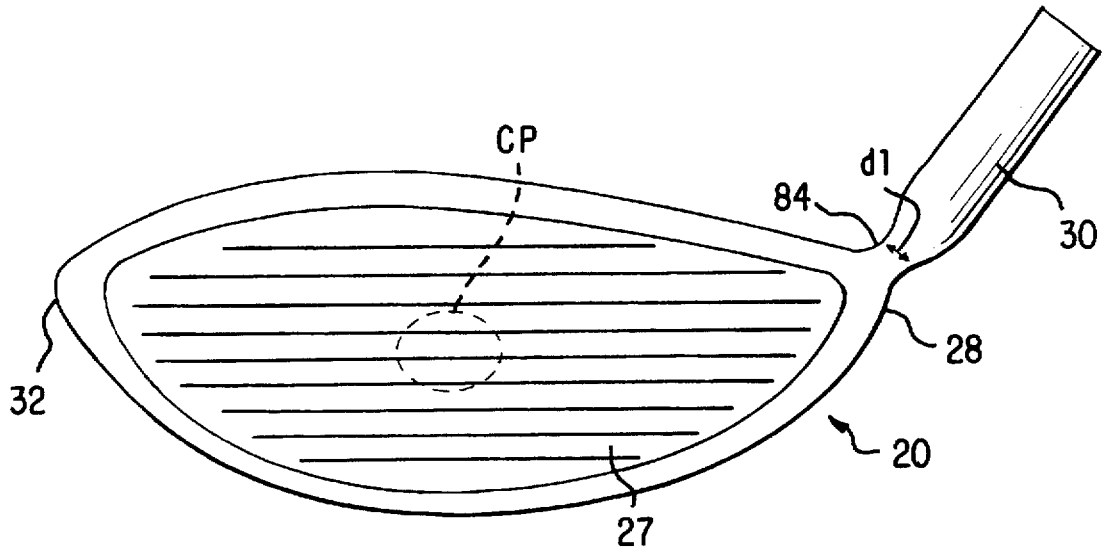
FIG. 4 is a front view or club face view of the metalwood of FIG. 1.
Figure 5:
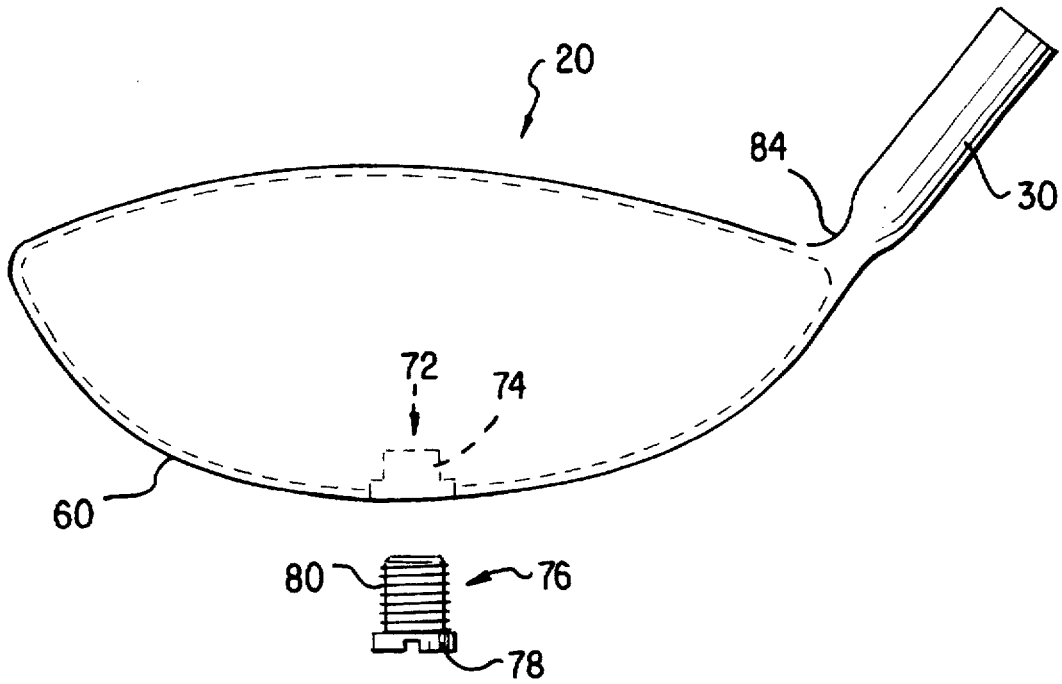
FIG. 5 is a cross-sectional view taken along line 5—5 of the metalwood of FIG. 3.

Referring to FIG. 2, a plurality of concentric masses 37, 39 and 41 are provided on the rear surface 40 of the face and hosel piece 22 at about the location of the center of percussion CP. Concentric masses 37, 39 and 41 are formed as raised edges extending rearwardly from the rear surface 40. Concentric mass 37 has the smallest diameter, and is preferably positioned substantially behind the center of percussion CP. Concentric mass 39 has a diameter which is larger than the diameter of mass 37, which is in turn positioned inside the mass 39. Similarly, concentric mass 41 has a diameter which is larger than the diameter of mass 39, which is in turn positioned inside the mass 41. The diameter of concentric mass 41 is preferably larger than the diameter of a golf ball. By increasing the mass directly behind the center of percussion CP, the energy transferred to the ball upon impact is increased, thereby increasing the distance the ball travels.

Figure 7:
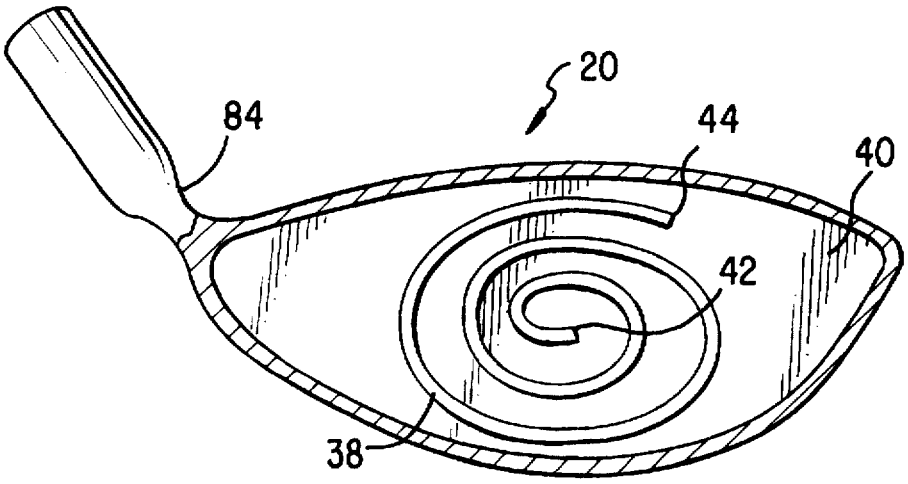
FIG. 7 is a rear view of the face plate of the metalwood of FIG. 1 illustrating a modification of the weight.

FIG. 7 illustrates a modification to the weighting provided on the rear surface 40 of the face and hosel piece 22. A spiral mass 38 is provided on the rear surface 40 of the face and hosel piece 22 at about the location of the center of percussion CP. The spiral mass 38 is formed as a raised edge extending rearwardly from the rear surface 40, and begins at an inner end 42 and spirals gradually to a wider diameter until it terminates at an outer end 44. The smallest diameter of the spiral mass 38 is preferably smaller than the diameter of a golf ball, and widest diameter of the spiral mass 38 is preferably larger than the diameter of a golf ball.

In addition, the face and hosel piece 22 has a top edge 46, a bottom edge 48 having a first end terminating at the toe portion 32 of the top edge 46 and a second end terminating at the hosel 30, and a curved hosel edge 50 below the hosel 30 having one end terminating at the heel portion 28 of the top edge 46 and another end terminating at the second end of the bottom edge 48. As shown in FIG. 2, the top edge 46 and the bottom edge 48 are raised rearwardly from the rear surface 40 of the face and hosel piece 22.

Figure 6:
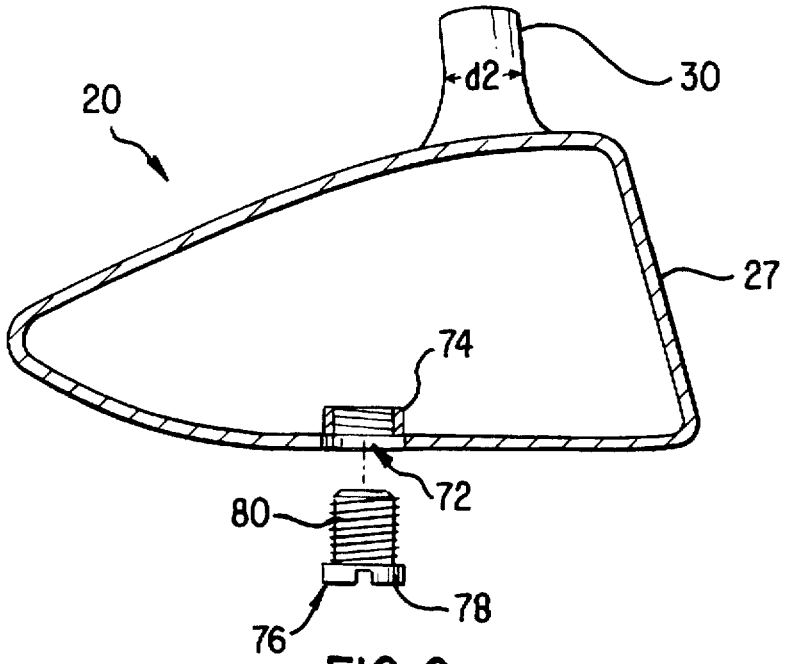
FIG. 6 is a cross-sectional view taken along line 6—6 of the metalwood of FIG. 3.

In addition, as shown in FIGS. 1, 2, 4, 5 and 7, the hosel 30 has a section, indicated by the numeral 84, which is "pinched" or narrowed to a dimension or width d1 adjacent the heel portion 28 in the direction extending from the heel portion 28 to the toe portion 32. The dimension or width d2 of the hosel 30 in the front to rear direction, as shown in FIGS. 1 and 6, remains the same throughout the hosel 30. Therefore, the width d1 of the narrowed hosel section 84 is less than the width d2 that is substantially transverse to it. The "pinched" or narrowed hosel 30 provides an aerodynamic configuration which reduces drag and reduces hosel and club head torque at impact, thereby increasing club head speed. This "pinched" design also adds strength to the hosel 30 in the front to rear direction, especially when the face 27 of the club head 20 impacts the golf ball.

The crown piece 24 has a slightly convex upper cover having a peripheral edge 52, a front edge 54 having a first end terminating at a first end of the peripheral edge 52 as indicated by numeral 55 in FIG. 1, and a curved edge 56 having a first end terminating at a second end of the peripheral edge 52 as indicated by numeral 57 in FIG. 1, and a second edge terminating at a second end of the front edge 54 as indicated by numeral 58 in FIG. 1.

The bottom piece 26 includes a sole plate 60 and a peripheral side 62 which are forged or stamped as one piece. The bottom piece 26 has a peripheral edge 64 along the top of the peripheral side 62, and a front edge 66 having a first end terminating at a first end of the peripheral edge 64 adjacent the toe portion 32 as indicated by numeral 68 in FIG. 1. The front edge 66 has a second end terminating at a second end of the peripheral edge 64 adjacent the heel portion 28 as indicated by numeral 70 in FIG. 1.

Referring to FIGS. 1, 3, 5 and 6, the sole plate 60 is provided, preferably but not necessarily at a central portion, with an opening 72 having threads 74 that are adapted to threadably engage a removable threaded weight 76. In a preferred embodiment, the threaded weight 76 takes the form of a screw having a head 78 connected to a threaded shaft 80. One set of threaded weights 76 can be provided to the golfer, with the set comprising a plurality of weights 76, each having a different weight. The difference in weight for each weight 76 can be achieved by providing the different weights 76 in different lengths, with the longer weights 76 having a greater weight, by providing the different weights 76 in the same lengths but with different weights, or by other conventional methods known to those skilled in the art. The golfer can then select the desired weight 76 and then threadably secure the weight 76 to the sole plate 60. Thus, the present invention provides a plurality of threaded weights 76 which can be easily removed and replaced without the need to use special tools, even during a round of golf. This provides a substantial benefit over previously-known weights, most of which are permanently secured to the club head and are cannot be easily removed and replaced without the use of special tools during a round of golf. With the set of replaceable weights 76 provided by the present invention, a golfer can use different weights 76 to adjust to the characteristics of the golf course, the weather, and the golfer's physical abilities during a given round of golf. For example, when playing a wet golf course after a lot of rain, a golfer may choose to use a heavier weight 76 to facilitate higher flying shots since the wet course will offer less roll after the ball hits the ground.

To manufacture the golf club head 20 according to the present invention, each of the face and hosel piece 22, the crown piece 24 and the bottom piece 26 is formed by stamping or forging a metal, such as steel, aluminum alloy or titanium, or a composite material, such as graphite or kevlar. The three separate pieces 22, 24 and 26 are then attached together, by welding, epoxying, screwing, or other conventional methods, to form the club head 20. The peripheral edge 52 of the crown piece 24 is attached to the peripheral edge 64 of the peripheral side 62 of the bottom piece 26. The front edge 54 of the crown piece 24 is attached to the top edge 46 of the face and hosel piece 22, and the front edge 66 of the bottom piece 26 is attached to the bottom edge 48 of the face and hosel piece 22. The curved edge 56 of the crown piece 24 is attached to the curved hosel edge 50 of the face and hosel piece 22. The sequence of attachment is not critical, and any two of the three pieces can be attached together first, or all three pieces attached together at the same time. After the three pieces 24, 26 and 28 have been attached, the shaft 34 is fitted into the hosel 30 and secured thereto by epoxy or high stress adhesive.

The golf club head 20 manufactured according to the present invention can be made with loft angles that are consistently close to the desired loft angles, and to avoid inconsistencies that may be caused by attaching separate face and hosel pieces. Since the present invention stamps the hosel 30 in one piece with the face 27, the resulting club head 20 can be provided with a loft angle that is very close to the desired loft angle. As explained above, consistently manufactured face pieces are important because the face of a metalwood is a critical part of the club head. In addition, providing the hosel 30 and the face 27 in one piece means that this combined face and hosel piece 22 only needs to be attached to two other pieces, thereby reducing the total welding edges around the face 27, and for the entire club head. This in turn strengthens the structure of the resulting club head 20 around the face 27.

The golf club head 20 according to the present invention further includes design features that enhance the performance of the club head. For example, the narrowed hosel section 84 provides increased strength in the rear to front direction, thereby helping the golfer to hit the ball further. In addition, weights or masses are provided in selected locations to assist the golfer in hitting the ball further and more accurately. As an example of such weights or masses, the concentric masses 37, 9 and 41, and the spiral mass 38, provide increased mass behind the center of percussion CP to increase the energy transferred to the ball upon impact, thereby increasing the distance while decreasing deflection of the face and increasing the strength of the face. Another example of the weights or masses is the replacable threaded weight 76, which provides an easy-to-use replaceable system of weights that can be used by a golfer to adapt to the given environment for each round of golf.

Some non-limiting dimensions will now be provided, although it will be appreciated by those skilled in the art that these dimensions represent mere examples, and that these dimensions may be modified without departing from the spirit and scope of the present invention. For instance, the narrowed width d1 of the narrowed hosel section 84 preferably ranges from about 0.275 inches to about 0.325 inches. The normal width d2 of the hosel preferably ranges from about 0.475 inches to about 0.525 inches. The diameter of the opening 72 preferably ranges from about 0.375 inches to about 0.425 inches to accomodate threaded weights 76 with similar diameters and lengths ranging from about 0.25 inches to about 0.85 inches. Alternatively, the weight of the threaded weights 76 can range from about 0.5 grams to about 2.0 grams.

It will be appreciated by those skilled in the art that modifications to the structure of the club head 20 shown and described above may be provided without departing from the spirit and scope of the present invention. By way of example only, and in no way intending to limit the alternatives that can be encompassed by the appended claims, it is possible for the club head 20 of the present invention to be provided in the following configurations: (1) with either the concentric masses 37, 39, 41 or the spiral mass 38, and the "pinched" hosel section 84, but without the threaded weight 76; (2) with the concentric masses 37, 39, 41 or the spiral mass 38, and the threaded weight 76, but without the "pinched" hosel section 84; (3) with the "pinched" hosel section 84 and the threaded weight 76, but without the masses behind the face 27; or (4) with one of the concentric masses 37, 39, 41, the spiral mass 38, the "pinched" hosel section 84, or the threaded weight 76, but without the other three.

Further yet, the material used for the club head is not critical. Therefore, for the purposes of the present invention, the term "metalwood" as used herein includes club heads made of either metal or composite material, such as kevlar, graphite or carbon.

While the description above refers to particular embodiments of the present invention, it will be understood that many modifications may be made without departing from the spirit thereof.

What is claimed is:

1. A metalwood golf club head, comprising:

a ball-striking face having a toe, a heel, a top edge, a bottom edge, a center of percussion located at an approximate center of the face, a rear surface, and a spiral mass provided at the rear surface of the face behind the center of percussion;

a hosel connected to the face, the hosel having a diameter and a narrowed section adjacent the heel and having a width from the toe to heel direction which is less than the diameter of the hosel; and a sole plate connected to the face, the sole plate comprising a threaded opening and a removable weight threadably coupled to the threaded opening.

2. The club head of claim 1, wherein the spiral mass comprises a raised edge extending rearwardly from the rear surface, and further comprising an inner end and an outer end, with the spiral mass extending gradually in a spiral manner to a wider diameter from the inner end to the outer end.

3. A metalwood golf club head, comprising:

a ball-striking face having a toe, a heel, a top edge, a bottom edge, a center of percussion located at an approximate center of the face, a rear surface, and a plurality of concentric masses provided at the rear surface of the face substantially behind the center of percussion;

a hosel connected to the face, the hosel having a diameter and a narrowed section adjacent the heel and having a width from the toe to heel direction which is less than the diameter of the hosel; and a sole plate connected to the face, the sole plate comprising a threaded opening and a removable weight threadably coupled to the threaded opening.

4. The club head of claim 3, wherein the plurality of concentric masses comprises at least a first concentric mass and a second concentric mass, the first concentric mass having a diameter which is smaller than the diameter of the second concentric mass and being positioned inside the second concentric mass.

5. The club head of claim 1, further comprising a set of removable weights, each removable weight having a different weight, and wherein one of the removable weights is threadably coupled to the threaded opening.

6. The club head of claim 5, wherein each removable weight has a different length.

7. The club head of claim 1, wherein the face and the hosel are provided together in one stamped piece.

8. A metalwood golf club head, comprising:

a face and hosel piece comprising a face and a hosel provided in one stamped piece, the face having a toe, a heel, a top edge, a bottom edge, and a center of percussion located at an approximate center of the face, the hosel having a diameter and a narrowed section adjacent the heel and having a width from the toe to heel direction which is less than the diameter of the hosel;

a crown piece comprising a peripheral edge and a front edge;

a bottom piece having a peripheral side wall connected to a sole plate, the peripheral side wall comprising a peripheral edge, and the sole plate comprising a front edge; and wherein face and hosel piece, the crown piece and the bottom piece are provided as three distinct stamped pieces, with the peripheral edge of the crown piece attached to the peripheral edge of the bottom piece, the front edge of the crown piece attached to the top edge of the face and hosel piece, and the front edge of the bottom piece attached to the bottom edge of the face and hosel piece.

9. The club head of claim 8, wherein the face and hosel piece further comprises a curved hosel edge below the hosel, and the crown piece further comprises a curved edge adjacent the heel, wherein the curved edge of the crown piece is attached to the curved hosel edge of the face and hosel piece.

10. The club head of claim 8, wherein the sole plate comprises a threaded opening, and wherein the club head further comprises a removable weight threadably coupled to the threaded opening.

11. The club head of claim 10, further comprising a set of removable weights, each removable weight having a different weight, and wherein one of the removable weights is threadably coupled to the threaded opening.

12. The club head of claim 11, wherein each removable weight has a different length.

13. The club head of claim 8, wherein the face comprises a rear surface, and a spiral mass provided at the rear surface of the face behind the center of percussion.

14. The club head of claim 13, wherein the spiral mass comprises a raised edge extending rearwardly from the rear surface, and further comprising an inner end and an outer end, with the spiral mass extending gradually in a spiral manner to a wider diameter from the inner end to the outer end.

15. The club head of claim 8, wherein the face comprises a rear surface, and a plurality of concentric masses provided at the rear surface of the face substantially behind the center of percussion.

16. The club head of claim 15, wherein the plurality of concentric masses comprises at least a first concentric mass and a second concentric mass, the first concentric mass having a diameter which is smaller than the diameter of the second concentric mass and being positioned inside the second concentric mass.

17. A method of manufacturing a metalwood golf club head, comprising the steps of:

(a) providing three distinct stamped pieces:

(i) a face and hosel piece comprising a face and a hosel provided in one stamped piece, the face having a toe, a heel, a top edge, a bottom edge, and a center of percussion located at an approximate center of the face, the hosel having a diameter and a narrowed section adjacent the heel and having a width from the toe to heel direction which is less than the diameter of the hosel;

(ii) a crown piece comprising a peripheral edge and a front edge; and (iii) a bottom piece having a peripheral side wall connected to a sole plate, the peripheral side wall comprising a peripheral edge, and the sole plate comprising a front edge;

(b) attaching the peripheral edge of the crown piece to the peripheral edge of the bottom piece;

(c) attaching the front edge of the crown piece to the top edge of the face and hosel piece; and (d) attaching the front edge of the bottom piece to the bottom edge of the face and hosel piece.

18. The method of claim 17, further comprising the step of providing either a plurality of concentric masses or a spiral mass at a rear surface of the face behind the center of percussion.

19. The method of claim 17, wherein the sole plate further comprises a threaded opening, and further comprising the steps of:

(e) providing a set of removable weights, each removable weight having a different weight; and (f) threadably coupling one of the removable weights to the threaded opening.

* * * * *